US007314031B2

(12) United States Patent
Le Troadec et al.

(10) Patent No.: US 7,314,031 B2
(45) Date of Patent: Jan. 1, 2008

(54) CAMSHAFT ARRANGEMENTS FOR ENGINES

(75) Inventors: Christophe Le Troadec, Rueil Malmaison (FR); Yves Gourlay, Montigny le Bretonneux (FR)

(73) Assignee: Renault s.a.s., Boulogne Billancourt (FR)

( * ) Notice: Subject to any disclaimer, the term of this patent is extended or adjusted under 35 U.S.C. 154(b) by 179 days.

(21) Appl. No.: 10/815,844

(22) Filed: Apr. 2, 2004

(65) Prior Publication Data

US 2004/0255885 A1 Dec. 23, 2004

(30) Foreign Application Priority Data

Apr. 2, 2003 (EP) ..... 03290829

(51) Int. Cl.
*F01L 1/04* (2006.01)

(52) U.S. Cl. ..... 123/90.6; 74/567; 29/888.1; 403/277

(58) Field of Classification Search ..... 123/90.6; 29/888.1; 74/567; 403/277
See application file for complete search history.

(56) References Cited

U.S. PATENT DOCUMENTS 3,800,579 A 4/1974 Breiter
4,512,441 A * 4/1985 Cooper ..... 184/105.3
4,660,269 A * 4/1987 Suzuki ..... 29/523
5,101,554 A * 4/1992 Breuer et al. ..... 29/888.1
5,447,385 A * 9/1995 Swars ..... 403/277
5,469,759 A 11/1995 Orsini, Jr.
5,627,464 A 5/1997 Shinjo et al.
5,987,973 A * 11/1999 Fujii et al. ..... 73/116
6,182,361 B1 2/2001 Cox et al.
2002/0011222 A1 1/2002 Bilek et al.

FOREIGN PATENT DOCUMENTS

DE 101 29 419 1/2003
GB 2 263 516 7/1993

* cited by examiner

*Primary Examiner*—Zelalem Eshete
(74) *Attorney, Agent, or Firm*—Oblon, Spivak, McClelland, Maier & Neustadt, P.C.

(57) ABSTRACT

A camshaft assembly 16 is disclosed for an engine 10, along with a method of producing the camshaft 16. The camshaft includes a support shaft 22 that carries in the region of one end 26 a camshaft element. The camshaft element may comprise a rotation sensor target member 24 and the support shaft 22 is preferably a tubular shaft. The camshaft element 24 is captured onto the support shaft 22 by deforming a deformation zone 46 at the end of the support shaft 22 into a radially extending rivet head 28.

23 Claims, 5 Drawing Sheets

CAMSHAFT ARRANGEMENTS FOR ENGINES

FIELD OF THE INVENTION

The present invention relates to camshaft arrangements for engines and in particular to a camshaft including a camshaft element mounted thereon for co-rotation therewith. Such a camshaft element may comprise, for example but not exclusively, a target member for a camshaft rotational speed and position sensing arrangement.

BACKGROUND OF THE INVENTION

It is known to provide camshafts with targets for rotational speed and position sensors and a prior art example can be found in GB-2317958. In this arrangement, the camshaft sensor target is formed in one piece with the camshaft itself. This requires machining operations to be carried out on the camshaft so as to produce the target lobes from solid.

Instead of forming the sensor target in one piece with the camshaft, in some arrangements a camshaft sensor target is formed as a separate component and is then attached to the camshaft for co-rotation. Examples of such arrangements may be found in U.S. Pat. Nos. 5,627,464, 5,987,973 and in U.S. Pat. No. 6,277,045. In each of these cases, a separate component incorporating a camshaft sensor target is attached to an end of the camshaft using a threaded fastener.

In many instances of camshaft rotational speed and position sensing, it may be noted that accuracy of the whole arrangement is very sensitive to variations in the air-gap between a sensor and its target on the camshaft. The width of the sensor-to-target air-gap is often dependent on a tolerance stack that comprises essentially two components. The first part is the tolerance stack built up in making the sensor itself and putting it into position, often on a bracket or boss on the cylinder head or cam-cover. The second component is the tolerance stack in making the target, fitting it to the camshaft and in putting the camshaft into place with due consideration to running clearances and wear in service. When the need arises to provide a camshaft sensor target on a portion of a camshaft that is not solid, particular problems may arise in relation to distortion of the target and/or the camshaft, with subsequent adverse effects on the associated part of the tolerance stack.

It is also known to construct composite camshafts and a recent example of such a prior art camshaft is disclosed in U.S. Pat. No. 6,182,361. In this particular arrangement, camshaft lobes and journal elements are made as components that are initially separate from a tube forming the basis of the camshaft. The lobes and journals are then pushed onto the tube and fixed in place by a permanent interlock. The preferred approach is to stake or crimp the lobes and journals in place, with alternatives of welding and brazing being suggested. While the suggested methods of interlocking may be acceptable for cam lobes and bearing journals, it should be born in mind that these are fairly sizable parts.

If a target arrangement for camshaft rotational speed and position sensing is to be provided on a portion of a camshaft that is not solid, it may prove difficult to hold it in position with a sufficient level of accuracy. This is particularly so if the target used is formed from a thin plate. For example, with a hollow portion of a camshaft, staking in place a pre-formed target by crimping it to the hollow portion may result in crush deformation of the target, the shaft or both. That in turn may cause variations in sensor-to-target air-gap tolerance that are unacceptable. Similar problems may arise from heat joints such as welding or brazing due to distortion on heating or cooling and shrinkage. In addition, such heat joints call for complicated production methods and equipment. The thinner the material from which the target is made, the greater will be the risk of distortion. Furthermore, in fixing a separate target member to a hollow portion of a camshaft, it is apparent that use of a mechanical fixing such as a threaded fastener may not be practical.

Similar problems, at least in alignment, may occur in cases where the camshaft element is one configured for transferring drive to or from the camshaft. Such an element may comprise a gear wheel or pulley for "V" belts or toothed drive belts.

There is therefore a continuing need to apply camshaft elements such as sensor targets to camshafts and to do so with good build consistency in high volume applications. It is also apparent that this need may be particularly difficult to satisfy if such a camshaft element is to be applied to a portion of a camshaft that is hollow.

SUMMARY OF THE INVENTION

It is an object of the present invention to provide an improved camshaft arrangement for an engine.

Accordingly, the present invention provides a camshaft for an engine, said camshaft comprising a support shaft carrying in the region of one end thereof a camshaft element for co-rotation therewith, said camshaft element being captured on said support shaft by the head of a rivet formed from plastic deformation of said end of said support shaft.

Said support shaft may include a hollow portion extending inwardly from one end thereof. Said support shaft may comprise a tube. Said hollow portion may extend through at least a part of the portion of said support shaft that is configured to support said camshaft element.

Said rivet may comprise a radially extending eyelet rivet. Said rivet head may be formed by means of a radial cold flow forming technique, such as an orbital or daisy riveting technique. Said rivet head may be formed from a deformation zone of said support shaft, which zone overhangs said camshaft element when in place and preferably includes, at least before deformation, a hollow rim at said end.

Said camshaft element may comprise a rotation sensor target member, preferably a substantially planar target member and preferably formed from a sheet or plate material. Said camshaft element may be located on a journal at the end of said support shaft and may be captured against a shoulder on said support shaft by said rivet head. Said camshaft element may also comprise a drive member configured to transfer rotational drive to or from said camshaft. Said drive element may comprise a gear wheel or a wheel configured for belt drive such as a "V" drive or a concentrically ribbed drive or a toothed drive.

The present invention also provides a method of producing a camshaft for an engine, the method including:

a) providing a support shaft having an end portion adapted to support a camshaft element, said support shaft preferably including a hollow portion extending inwardly through or into said end portion and more preferably comprising a tube;

b) providing on said end portion a shaft element for co-rotation with said support shaft, such as a rotation sensor target member; and c) capturing said shaft element onto said support shaft by plastically deforming a deformation zone of said end portion into a radially extending rivet head.

The method may include riveting said shaft element onto said support shaft using a radial cold flow forming technique. The method may include riveting said shaft element onto said support shaft using an orbital or daisy riveting technique.

The present invention also provides an engine including a camshaft according to the present invention or a camshaft made according to the method of the present invention.

BRIEF DESCRIPTION OF THE DRAWINGS

The present invention will now be described by way of example only and with reference to the accompanying drawings, in which.

DETAILED DESCRIPTION OF A PREFERRED EMBODIMENT OF THE INVENTION

Figure 1:
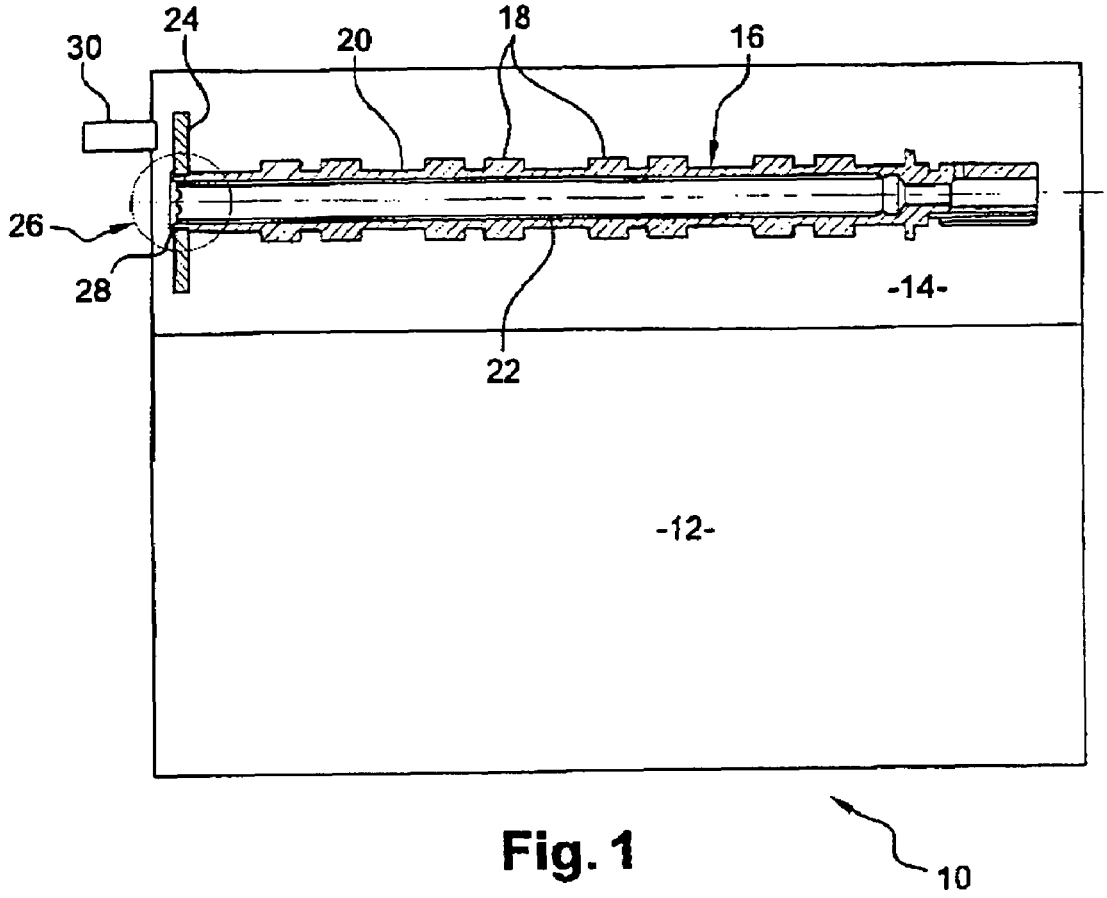
FIG. 1 is a side view of an engine including a camshaft assembly according to the present invention.

Referring to the drawings, an engine 10 includes a cylinder block 12 on which is mounted a cylinder head 14. An overhead camshaft assembly 16 runs in the cylinder head 14. The camshaft 16 is a tubular camshaft and is built up from a series of camshaft elements that include a series of camshaft lobes 18 and bearing journals 20, each of which is interlocked onto a tubular support shaft 22.

The camshaft 16 carries a further camshaft element in the form of a rotation sensor target member 24 that is mounted onto one end 26 of the camshaft 16. The target member 24 is fixed onto the camshaft 16 by a rivet head 28 formed from plastic deformation of the support shaft 22 itself, the support shaft 22 acting as the shank of the rivet 22, 28 thus formed. The technique for formation of the rivet head 28 will be described in greater detail below. The rivet head 28 keeps the target member 24 in place on the support shaft 22, at least from the point of view of axial location and preferably also ensures co-rotation with that shaft 22 of the target member 24.

The target member 24 is used in co-operation with a sensor 30 for the detection of the rotational speed and/or position of the camshaft 16. The information thus obtained may be processed to determine the phase of the camshaft 16 in relation to the rotation of an associated crankshaft (not illustrated) and the phase information may typically be used for timing fuel injection events or controlling variable valve timing.

The sensor 30 may be axially reading as illustrated, i.e. end-on to a planar face 32 of the target member 24, or may be radially reading. Target form will depend on the type of sensor 30 used and the information sought and may for example comprise a hall effect sensor. The target member 24 may conveniently be formed from a substantially planar material such as a sheet or thin plate. A typical thickness may be a few millimeters.

The target member planar face 32 extends radially outwards from a region of the target member 24 that sits on a target journal 34 of the support shaft 22. This region of the target member 24 may for convenience be referred to as the target hub 36 and, when in position on the support shaft 22, preferably extends all the way around the target journal 34.

The target journal 34 and may be of reduced diameter in comparison with the rest of the tubular support shaft 22. The target member 24 is fitted onto the target journal 34, e.g. by sliding or pressing, and is preferably positioned close to or substantially abutting a shoulder 38. The length of the target journal 34 is fixed by the axial position of the shoulder 38 and this feature in turn fixes the nominal axial position on the camshaft assembly 16 of the target face 32. The outer edge of the shoulder 38 is preferably lightly chamfered or de-burred so as to reduce the likelihood of burrs or similar interfering with proper axial positioning of the target member 24 or of distorting it and resulting in axial run-out.

The retention of the target member 24 on the support shaft 22 will now be discussed in some more detail with respect to two specific but non-limiting variations of the present invention. In each case, however, it will be noted that it is a rivet head 28 formed by plastic deformation of an end 26 of the support shaft 22 itself that holds the target member 24 in position, at least axially and also for co-rotation.

Figure 2:
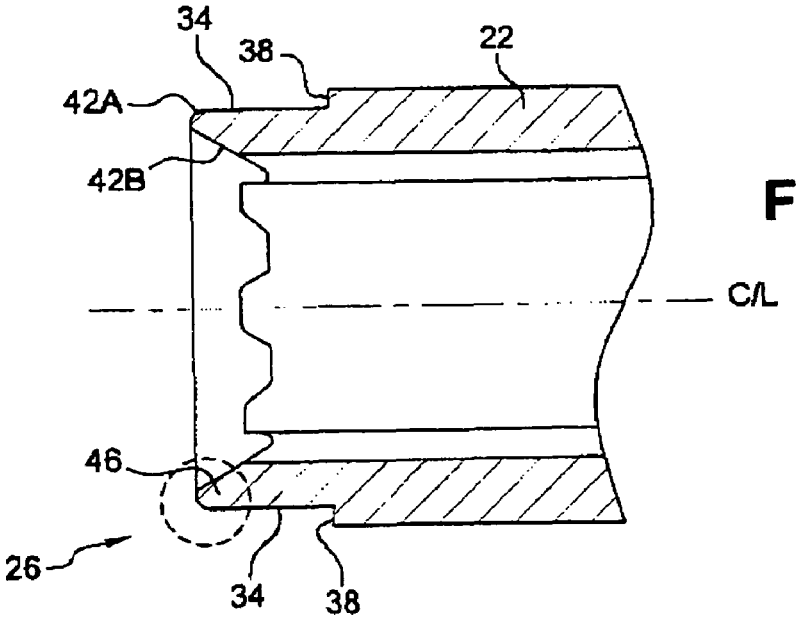
FIG. 2 is a partial view of one end of the camshaft of FIG. 1 before completion of its manufacture.
Figure 3:
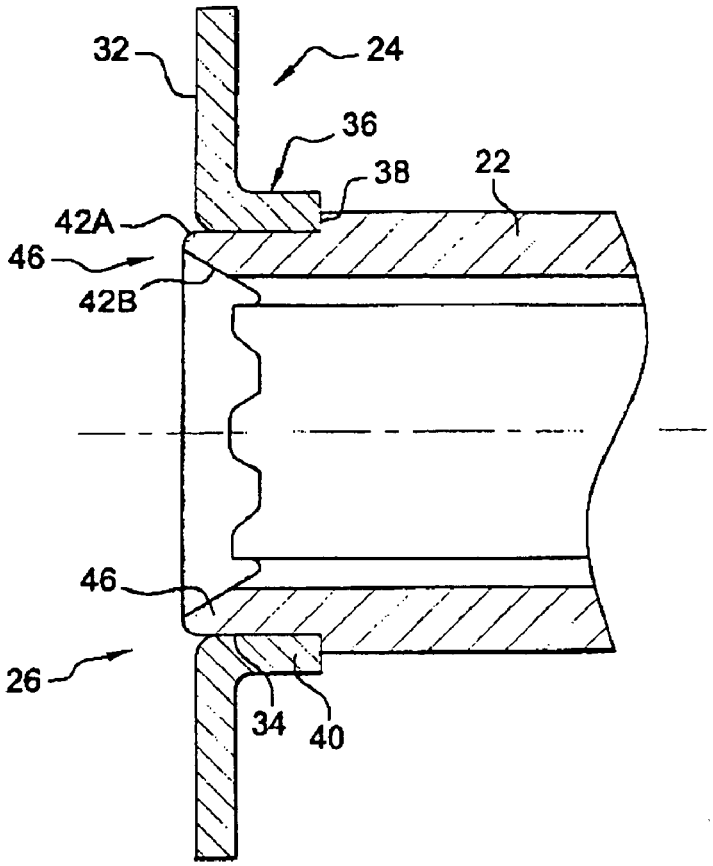
FIG. 3 is the view of FIG. 2 with a camshaft element assembled onto that end.
Figure 4:
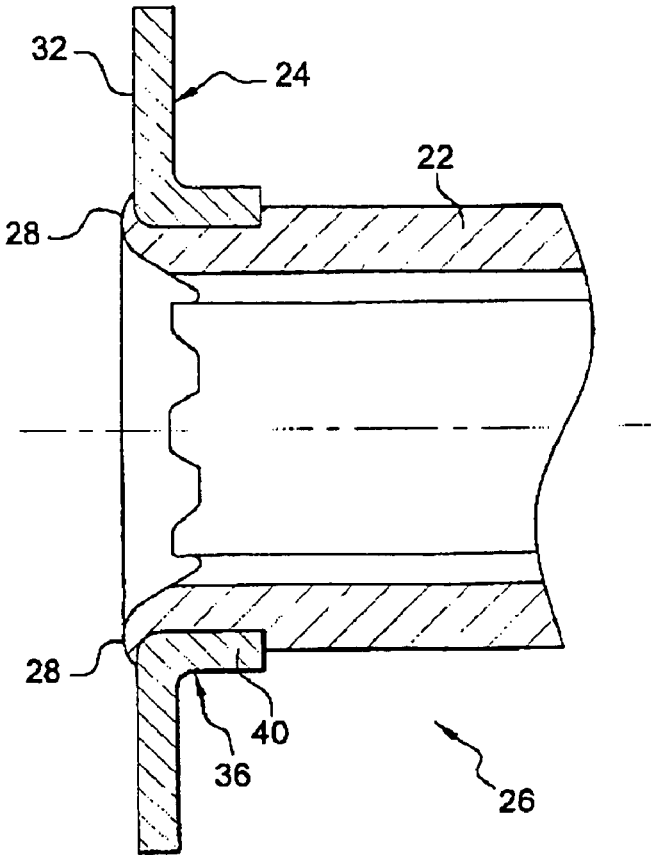
FIG. 4 is the view of FIG. 3 on completion of a manufacturing operation according to the present invention.

Referring for the moment in particular to FIGS. 2 to 4, the end region 26 of the tubular support shaft 22 is considered in some detail for a camshaft assembly 16 according to a first version of the present invention. In this version, the target hub 36 may comprise a tubular portion 40 that extends axially away from the target face 32 and may be formed by for example a pressing or stamping technique. In use, the tubular portion 40 of the target hub 36 sits on the target journal 34 such that the free end of the tubular portion 38 butts up against the shoulder 38 that defines the inner end and therefore length of the target journal 34.

At the opposite end of the tubular portion 40 the target hub 36 supports the target face 32, which is therefore spaced away from the shoulder 38. This ensures that the distance from the datum provided by the shoulder 38 to the target face 32 is substantially constant and is not affected by any curvature present in the translation of the target hub 36 from an axial to a radial direction.

Figure 5:
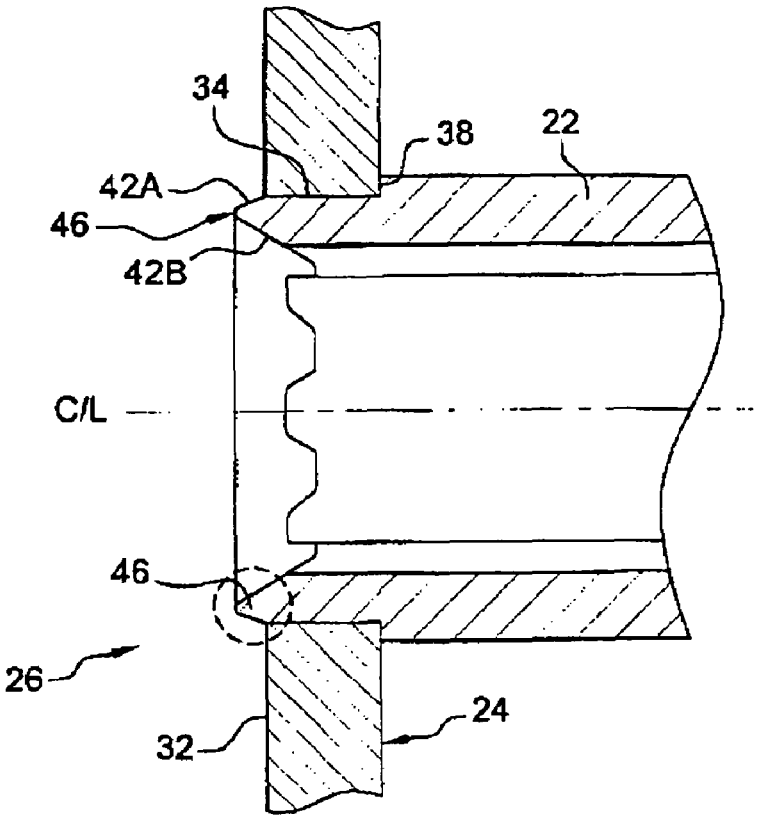
FIG. 5 is a variation of the arrangement of FIGS. 2 and 3.
Figure 6:
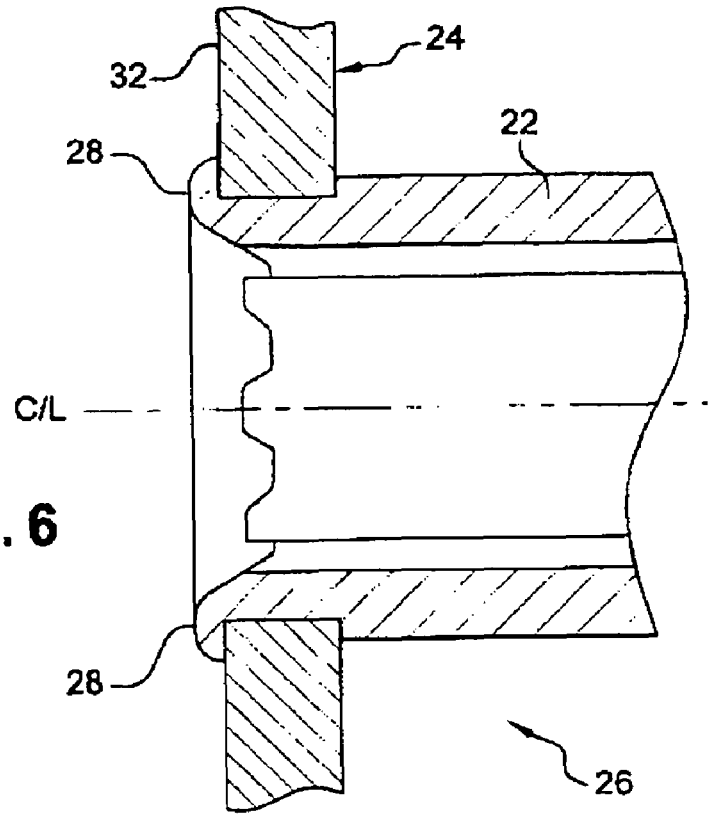
FIG. 6 is the view of FIG. 5 on completion of a manufacturing operation according to the present invention.

Referring now for the moment to FIGS. 5 and 6, in a second version of the present invention the target member 24 is confined to substantially one plane and may, for example, comprise a flat washer-type piece having targets in the form of holes or supported as radially extending teeth. In this case, it will be appreciated that production of the target member 24 may be simpler than in the first version but also appreciated that the length of the target journal 34 will preferably be correspondingly shorter.

In both versions, the end 26 of the support shaft 22 includes an external chamfer 42A adapted to ease initial introduction of the target member 24 onto the target journal 34. The inside of the support shaft may include an internal chamfer 42B. The length of the target member journal 34 is such that, once the target member 24 is in position, there is sufficient support shaft material overhanging the outer face of the target member as to permit formation of the rivet head 28 directly from the material of the support shaft 22 itself. This overhanging material may for convenience be referred to as a deformation zone 46, so as to indicate that it is this portion of the support shaft 22 that is used to form the rivet head 28.

The riveting of the target member 24 onto the end of the camshaft assembly 16 may be broadly the same for each of the exemplary arrangements under consideration and will therefore be discussed in common between them. By riveting is meant upsetting by plastic deformation a quantity of material so as to form a rivet head 28 that holds several assembled parts together. The rivet head 28 may for example be in the form of a bulge that extends radially away from the undisturbed diameter of the target journal 34. The rivet head 28 may be one of several shapes such as for example a substantially planar surface, a mushroom head or a countersunk rivet head. The specific shape of the rivet head 26 is preferably not a limiting factor, but rather the principle of forming the rivet head 28 out of the material of the support shaft 22 itself.

In the particular cases being discussed, the plastic deformation is applied by way of radial deformation of the end of the hollow support shaft 22, the deformation being applied outwardly so as to form such a rivet head that captures the target member 24 onto the target journal and prevents it from easily coming off the end 26 of the camshaft assembly 16. The rivet head 28 may then comprise a form of rivet known in the art as an eyelet rivet, e.g. indicating that the rivet head 26 is formed integrally with, and preferably from, a tubular or at least partially hollow member.

The purpose of the rivet head 28 is to capture the target member 24 on the camshaft assembly 16 against dismounting and preferably in such a manner that the target face 32 and any associated targets are fixed within predetermined tolerances for axial positioning and axial run-out. The tolerances themselves will be determined by the specific sensor installation employed. Such a sensor target member 24 is anticipated to be, in preference for a tubular camshaft 16, a lightweight part and an axial force applied by the rivet head 28 should be sufficient to hold the target member 24 against the shoulder 38 and guarantee co-rotation. It will be appreciated, however, that further fixation may be employed as necessary to ensure co-rotation and/or angular alignment, e.g. radial keying or splines.

It will also be appreciated that camshaft elements other than a rotation sensor target member 24 may be captured onto a camshaft assembly by means of a rivet head 28 formed out of the end of the camshaft 16. For example, if no target member 24 is to be fitted to the end of the camshaft 16, a rivet head 28 could be used to hold on a camshaft lobe, bearing journal, thrust plate or drive wheel, at least against axial displacement if not also against rotational slippage for which other locking techniques may be needed in addition. In one embodiment, the camshaft element may comprise an element configured to transmit drive to or from the camshaft.

It will also be noted that an embodiment of either version may be used in which the support shaft 22 is not necessarily tubular, or at least not hollow all the way through. For a partially solid support shaft, for example having a hollow portion extending inwardly from an end of the solid shaft into or through the target journal, the present invention may be applied in substantially the same way as for a hollow support shaft 22. For a camshaft 16 having the sensor target member mounted to a solid end, that end of the shaft could still be plastically deformed so as to form a rivet head without necessarily departing from the spirit and scope of the present invention when considered in its broadest sense. The present invention is, however, considered particularly suited to implementation for hollow or tubular camshaft assemblies 16.

Consideration will now be given to the method used to form the rivet head 28 out of the end 26 of the support shaft 22. A direct thrust or press riveting technique may be employed, but this is not preferred and in particular not preferred for tubular camshafts. The lack of preference is because, in using such a technique, the high thrust forces used may upset the rivet shank. In the case of a tubular camshaft 16, such upsetting of the shank may translate into radial run-out of the camshaft 16 at some point along its length. In addition, metallurgical problems may be caused in the region of the rivet head 28 due to rapid metal deformation and the process can be noisy. For this reason, a radial cold flow riveting process is much preferred, as will now be considered in reference to FIGS. 7 and 8.

Various such radial cold flow forming techniques are known and under one or more of several names, e.g. "orbital", "gyroscopic", "spin", "rocking", "wobble" "tumble" and "daisy" riveting. It may be noted that in certain equivalent cases a roller-head swaging process may be used and this may be considered to still fall within the general scope of the processes under discussion. The use of such techniques in the art of camshaft manufacture, and in particular for forming rivet heads out of the end of engine camshafts, is not disclosed to date to the present knowledge of the applicants.

Figure 7:
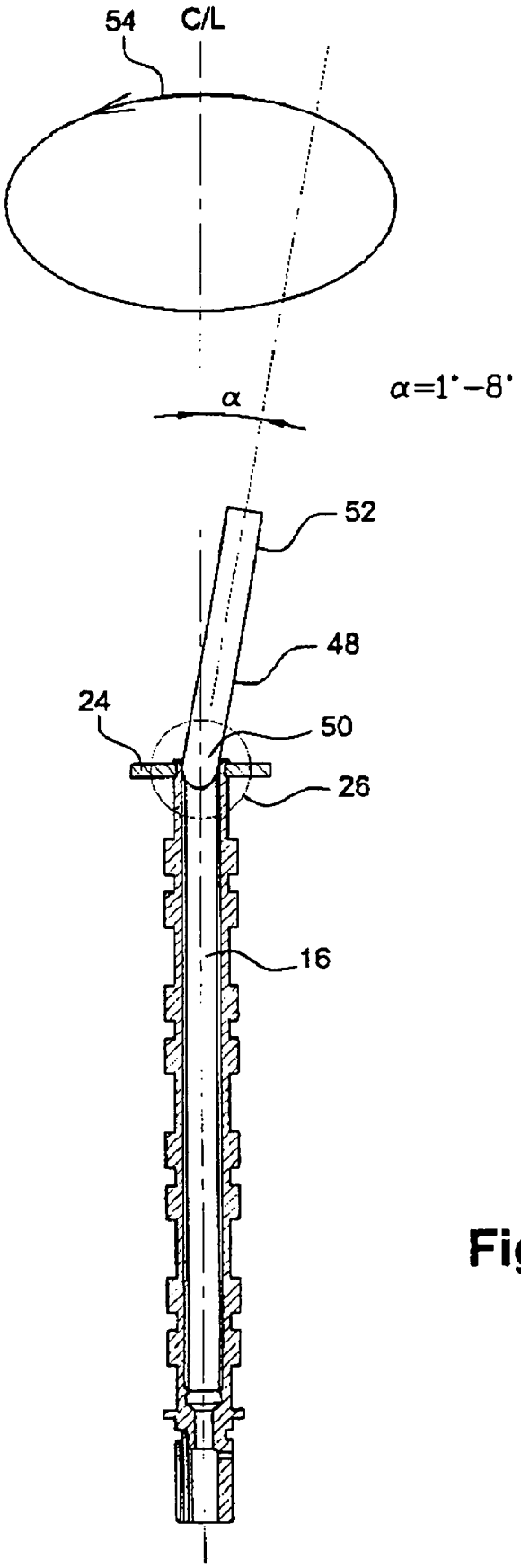
FIG. 7 is a representation of a manufacturing method according to the present invention.

Referring first in particular to FIG. 7, the general principle of a radial cold flow forming technique is illustrated in the form of a basic orbital or gyroscopic riveting motion. A tool member known in the art as a peen 48 is mounted in a machine head (not shown) at a predetermined angle. The rivet angle is set in dependence on the result desired, e.g. from 1° to 8°, and may be found by the skilled person during development testing. The peen 48 is angled towards the axis of rotation and its riveting anvil 50 sits inside for tubular or hollow rivet work-pieces 22 or on top for solid work-pieces.

The spindle of the machine head rotates the off-set end 52 of the peen 48 around the center-line of the machine head, which is preferably aligned with the center-line C/L of the camshaft 16. This rotation may be unidirectional and is represented as such by the circle 54, a typical rotary speed being 1500 to 3000 revolutions per minute. The peen 48 is then brought into contact with the deformation zone 46 of a hollow support shaft 22 of a camshaft 16 according to the present invention and a preferably constant pressure is applied, the target member 24 having already been fitted. The pressure and motion then gradually deforms the deformation zone 46 into a radially extending rivet head 28, such that the rivet head 28 and the support shaft 22 form a rivet 28, 22 of the type known sometimes in the art as an "eyelet rivet". This simple form of radial cold flow forming is quite rapid for the style of riveting and is economical, rendering it suitable for mass produced products like camshafts and in particular for tubular camshafts 16.

Figure 8:
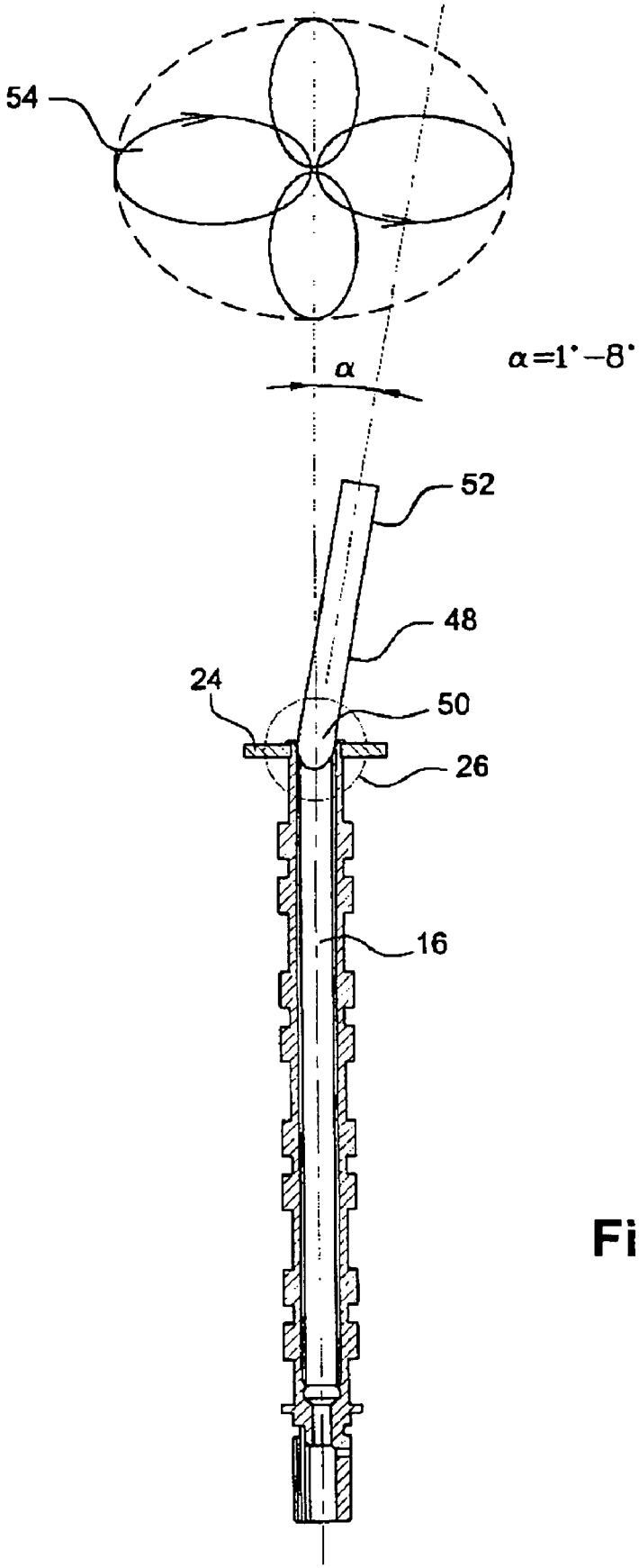
FIG. 8 is a variation to the method of FIG. 7.

Referring now in particular to FIG. 8, a variation on the theme of radial cold flow forming is considered in the form of so-called "daisy" riveting. The general principle is similar to the orbital or gyroscopic riveting discussed in relation to FIG. 7, the main difference being that the rotation scribes a more complex shape. By way of example four passes/petals are shown per cycle, the passes all touching the center and being angularly equi-spaced thereabouts. More passes or less are possible and the rivet set peen 48 may be considered to describe a petal for each revolution of the machine head spindle. The material may be pushed outwards as the peen 48 moves radially outwards and then inwards as the peen 48 moves back towards the center. This version usually increases the riveting time when compared with orbital riveting but may prove preferable if working with a thicker tubular support shaft or a solid one.

In any case, the use of a radial cold flow forming technique may well take longer per work-piece than simple press-riveting. However, the principle of operation means that the upsetting load applied to the support shaft 22 is up to six times lower than a press riveting technique to produce the same level of deformation of the deformation zone 46. The use of this significantly reduced upsetting load helps reduce the chances of distortion of the cam sensor target member 24 and of its support shaft 22.

The skilled person is referred to U.S. Pat. Nos. 3,899,909 and 3,800,579 and to several of the references cited therein for general guidance on the principles of radial cold flow forming. Further information may be gleaned from the Internet web-site "www.guillemin.net"

The improvements in target mounting and general camshaft production reduce the pressure on the sensor system with regard to tolerance stacking and help keep down camshaft production costs, as no welding or separate mechanical fixings are called for. There is little or no change in the structure of the parts being joined and only limited deformation and pressure need be put on them. As multiple head riveting machines can be used and the process is suitable for a high degree of automation, along with little noise pollution, the process is considered to be a significant improvement and addition to the art of camshaft production.

While the present invention has been particularly shown and described with respect to a preferred embodiment, it will be understood by those skilled in the art that changes in form and detail may be made without departing from the scope and spirit of the invention.

What we claim is:

1. A camshaft for an engine, said camshaft comprising a support shaft carrying in a region of one end thereof a camshaft element for co-rotation therewith, said support shaft is configured to capture the camshaft element thereon by a head of a rivet formed of a plastically deformed portion at said end of said support shaft that extends radially outward beyond a sidewall defining an opening in the camshaft element through which said end of said support shaft is configured to be disposed.

2. A camshaft according to claim 1, wherein said support shaft includes a hollow portion extending inwardly from said end.

3. A camshaft according to claim 2, wherein said support shaft comprises a tube.

4. A camshaft according to claim 1, wherein said rivet comprises a radially extending eyelet rivet.

5. A camshaft according to claim 1, wherein said rivet head is formed by a radial cold flow forming technique.

6. A camshaft according to claim 5, wherein said radial cold flow forming technique comprises an orbital riveting technique.

7. A camshaft according to claim 6, wherein said orbital riveting technique comprises a daisy riveting technique.

8. A camshaft according to claim 1, wherein said rivet head is formed from a deformation zone of said support shaft, which deformation zone overhangs said camshaft element when said camshaft element is in place.

9. A camshaft according to claim 8, wherein said deformation zone includes, at least before deformation, a hollow rim at said end.

10. A camshaft according to claim 1, wherein said camshaft element comprises a rotation sensor target member.

11. A camshaft according to claim 10, wherein said camshaft element comprises a substantially planar target member.

12. A camshaft according to claim 1, wherein said camshaft element comprises a drive member configured to transfer rotational drive to or from said camshaft.

13. A camshaft according to claim 1, wherein said camshaft element is formed from a sheet or plate material.

14. A camshaft according to claim 1, wherein said camshaft element is located on a journal at said end of said support shaft and is captured against a shoulder on said support shaft by said rivet head.

15. A camshaft according to claim 1, wherein the head of the rivet contacts a portion of the camshaft element other than a sidewall defining an opening in the camshaft element through which the end of the shaft is disposed.

16. A camshaft according to claim 1, further comprising:

at least one camshaft lobe positioned on the camshaft, wherein the rivet head is located outside the camshaft element in an axial direction from the camshaft lobe.

17. A camshaft according to claim 1, wherein the entire camshaft element fits between the rivet head and a shoulder on the support shaft in an axial direction of the support shaft.

18. A method of producing a camshaft for an engine, the method including:

a) providing a support shaft having an end portion adapted to support a camshaft element;

b) providing on said end portion a camshaft element for co-rotation with said support shaft; and c) capturing said camshaft element onto said support shaft by plastically deforming a deformation zone of said end portion into a radially extending rivet head that extends radially outward beyond a sidewall defining an opening in the camshaft element through which said end of said support shaft is configured to be disposed.

19. A method according to claim 18, including providing a hollow portion defined in said camshaft, said hollow portion extending inwardly through said end portion.

20. A method according to claim 18, including using a tube for said support shaft.

21. A method according to claim 18, including riveting said shaft element onto said support shaft using a radial cold flow forming technique.

22. A method according to claim 21, including using, for said radial cold flow formation, an orbital or daisy riveting technique.

23. An engine including a camshaft, said camshaft comprising a support shaft carrying in a region of one end thereof a camshaft element for co-rotation therewith, said support shaft is configured to capture the camshaft element thereon by a head of a rivet formed of a plastically deformed portion at said end of said support shaft that extends radially outward beyond a sidewall defining an opening in the camshaft element through which said end of said support shaft is configured to be disposed.

* * * * *